US005114083A

United States Patent [19]

Ikebuchi et al.

[11] Patent Number: 5,114,083

[45] Date of Patent: May 19, 1992

[54] METHOD AND APPATATUS FOR PULVERIZING MATERIAL

[75] Inventors: Iwao Ikebuchi; Yoshitaka Ihara; Hisashi Takei; Syozo Yamada; Mamoru Nakano; Akira Ganse, all of Osaka, Japan

[73] Assignee: Kubota, Ltd., Osaka, Japan

[21] Appl. No.: 465,178

[22] PCT Filed: Jun. 7, 1989

[86] PCT No.: PCT/JP89/00584

§ 371 Date: Feb. 12, 1990

§ 102(e) Date: Feb. 12, 1990

[87] PCT Pub. No.: WO89/11911

PCT Pub. Date: Dec. 14, 1989

[30] Foreign Application Priority Data

Jun. 10, 1988 [JP] Japan ..... 63-77459
Jun. 16, 1988 [JP] Japan ..... 63-150979

[51] Int. Cl.[5] ..... B02C 17/16

[52] U.S. Cl. ..... 241/153; 241/172; 241/179

[58] Field of Search ..... 366/297, 298, 299, 318; 241/153, 171, 172, 69, 72, 30, 179

[56] References Cited

U.S. PATENT DOCUMENTS

| | | | |
|---|---|---|---|
| 3,226,044 | 12/1965 | Matsubayashi et al. | 241/172 |
| 3,423,032 | 1/1969 | Eckert | 241/153 X |
| 3,533,566 | 10/1970 | Macquat | 241/153 |
| 3,770,214 | 11/1973 | Gabor | 241/153 X |
| 4,382,557 | 5/1983 | Duerr | 241/172 X |
| 4,848,676 | 7/1989 | Stehr | 241/172 X |

FOREIGN PATENT DOCUMENTS

| | | | |
|---|---|---|---|
| 1242078 | 6/1967 | Fed. Rep. of Germany | 241/172 |
| 3912187 | 6/1939 | Japan . | |
| 8210302 | 6/1942 | Japan . | |
| 48-44852 | 6/1973 | Japan . | |
| 57-41981 | 9/1982 | Japan . | |
| 59-131241 | 8/1984 | Japan . | |
| 1014584 | 4/1983 | U.S.S.R. | 241/172 |
| 2120126 | 11/1983 | United Kingdom | 241/172 |

*Primary Examiner*—Mark Rosenbaum
*Attorney, Agent, or Firm*—Wenderoth, Lind & Ponack

[57] ABSTRACT

The present invention relates to a method and apparatus for pulverizing a material to produce a fine powdery material such as silica powder as a material for a filler for sealing semiconductors. It has a shell and a screw shaft mounted in the shell. A disk having an inverted conical bottom surface is coaxially secured to the bottom of the screw shaft. The disk serves to protect the blade of the screw shaft from wear. Also owing to the inverted conical bottom surface, a centripetal force acts on the screw shaft while in rotation, thus preventing it from running out of true. By providing a plurality of screw shafts in the shell, the fluid in the shell flows in a complicated manner, thus increasing the pulverizing efficiency. A partitioning plate formed with a hole in the upper or lower part thereof may be provided between the adjacent screw shafts to minimize the possibility of shortcircuiting of the material from the inlet of the shell to its outlet. The respective screw shafts may have different revolving speeds, different heights or different screw pitches from one another to create a complicated fluid flow in the shell and thus to improve the pulverizing efficiency.

10 Claims, 5 Drawing Sheets

METHOD AND APPATATUS FOR PULVERIZING MATERIAL

TECHNICAL FIELD

The present invention relates to an apparatus for pulverizing a material to be pulverized by use of a pulverizing medium and by rotating a vertically extending screw shaft mounted in a vertical shell. According to the present invention, the screw shaft is prevented from running out of true and the material to be pulverized is prevented from shortcircuiting from an inlet to an outlet of the shell. Thus the present invention is suitable for the production of a fine granular material such as silica powder as a sealing filler for use with semiconductors.

BACKGROUND ART

A prior art apparatus is shown in FIG. 14 which comprises an upright shell 1 filled with a pulverizing medium b such as steel balls, and a vertically extending screw shaft 2 mounted in the shell 1. The material m to be pulverized is fed into the shell 1 with the screw shaft 2 in rotation to circulate the material m in the shell 1. When the material m is pulverized into a particulate product c having a desired particle size by the friction with the pulverizing medium b and between the particles of the material, it is entrained in the flow of air or water through the shell 1 to leave the shell. Other parts shown are a circulating fan 3, a product collector 4 such as a bag filter and a cyclone separator, and a rotary valve 5 for feeding the material m to be pulverized into the shell 1.

With this type of pulverizing apparatus, the screw blade tends to wear remarkably at its bottom portion 6*a* because the screw cuts into the material m and the pulverizing medium b at this portion. To protect that portion from wear, it has been a common practice to fuse a ceramic material or a wear-resistant alloy to the portion or form the portion of molded portions made of such materials.

But, it is troublesome and time-consuming to provide such a wear protective means. Its maintenance and replacement is also troublesome.

The screw shaft of Japanese Unexamined Utility Model Publication 59-131241 see (FIG. 15) or Japanese Examined Patent Publication 39-12187 see (FIG. 16) is a screw shaft 2 having a disk 7 coaxially secured to its bottom end. Thus the screw shaft is well protected against wear. The disk 7 itself is less liable to wear because it is not adapted to cut into the material m and the pulverizing medium b but come into contact with them on a flat surface.

But if the screw shaft 2 should run out of true, thus inclining the disk 7, the frictional resistance acting on the periphery of the disk 7 will be out of balance. This will increase the degree of runout of the screw shaft 2, thus imparing the pulverizing efficiency. If the screw shaft runs too much out of true, the operation of the machine might be impossible.

In the latter of the above-described publications, the disk 7 is provided on its bottom surface with radial ribs 8 having a triangular shape. The screw shaft 2 might run out of true violently if there is a substantial difference among the frictional resistances acting on these ribs.

Further, with such prior art pulverizers, part of the material m fed into the shell through its inlet 9*a* tends to be discharged directly to its outlet 9*b* without being pulverized. Thus it is necessary to provide a collector 9 such as a cyclone separator between the outlet 9*b* and a product collector as shown in the drawing to collect the product c flowing out of the outlet 9*b* and feed it back into the shell 1. If the fluid in the shell 1 is liquid, a collector 9 such as a settling classifier has to be provided as shown in FIG. 17 to collect only the coarser product c and feed it back into the shell 1 by means of a pump.

The provision of the collector 9 will not only make the machine bulky but also complicate the fluid control. Moreover, it is necessary to increase the driving force to drive the collector 9 which does not serve to pulverize the material. Thus the provision of the collector will increase the running cost and impair the pulverizing efficiency in comparison with the case in which no shortcircuiting of material takes place.

Another problem with a prior art pulverizer is that the pulverizing medium b tends to flow in a rather simple, concerted manner because only one screw shaft 2 is provided in the shell 1. The material m is thus liable to be discharged unpulverized from the shell, resulting in an increase in the content of coarser particles in the product c.

OBJECT AND BRIEF DESCRIPTION OF THE INVENTION

It is an object of the present invention to obviate the abovesaid shortcomings, to prevent or minimize the runout of the screw shaft and the discharge of material without being pulverized, and to improve the pulverizing efficiency.

DISCLOSURE OF THE INVENTION

In accordance with the present invention, the screw shaft is protected from wear by the provision of the disk coaxially secured to its bottom. The disk has its bottom surface shaped in an inverted cone so that a centripetal force will act thereon while the screw shaft is in rotation, thus keeping the screw shaft running true. Thus, it will have a long life and can pulverize the material smoothly.

In accordance with the present invention, in order to prevent the shortcircuiting of material, a plurality of screw shafts are used instead of one.

A partitioning wall may be provided between the adjacent screw shafts to divide the upper part of the layer of pulverizing medium. Also it may extend the whole length of the layer of pulverizing medium with a through hole formed in its upper or lower part so that the particulate product can flow through the partitioning walls in a zigzag manner.

Two screw shafts may be provided with a partitioning wall provided therebetween. Holes are formed in the upper and lower parts of the partitioning wall so as to circulate the material to be pulverized between the screw shafts through these holes. In order to circulate the material, the screw shaft in the front stage of pulverization may be revolved at a lower speed than the one in the rear stage of pulverization, the latter may be located nearer to the partitioning wall than the former, or the former may have a smaller screw pitch than the latter.

The pulverizing medium in the rear stage of pulverization may have a smaller particle size (diameter) than that in the front stage. In that case, screens are put over the holes in the partitioning wall to prevent the passage of pulverizing medium therethrough.

The adjacent screw shafts may have different heights or pitches or may be adapted to rotate at different speeds from each other.

When the plurality of screw shafts rotate, the fluid in the shell will flow so that the currents formed by the respective screw shafts will interfere with one another. The pulverizing medium will thus flow in random directions, causing the material to be pulverized smoothly and reducing the possibility of material being discharged unpulverized. The end product thus obtained contains only a small amount of coarse particles and the pulverizing efficiency increases.

In accordance with the present invention, a partitioning plate provided with a hole is provided between the screw shafts. By providing the partitioning plates, the material will be more effectively prevented from being discharged unpulverized. The partitioning walls will also serve to circulate the pulverizing medium as well as the material to be pulverized more smoothly, leaving no dead space where the material and the medium stagnate.

By covering the holes in the partitioning walls with a screen, the pulverizing medium is prevented from moving between adjacent chambers. This arrangement will make it possible to use pulverizing media having different particle sizes in different chambers. For example, the pulverizing medium in the front half portion of the shell may be larger in particle size than the one in the rear half portion. With this arrangement, a material having a larger particle size can be pulverized.

The screw shafts may have different pitches, heights or revolving speeds from one another to circulate the material and the pulverizing medium smoothly so that no dead space will be left in the shell.

DETAILED DESCRIPTION OF EMBODIMENTS OF THE INVENTION

Figure 1:
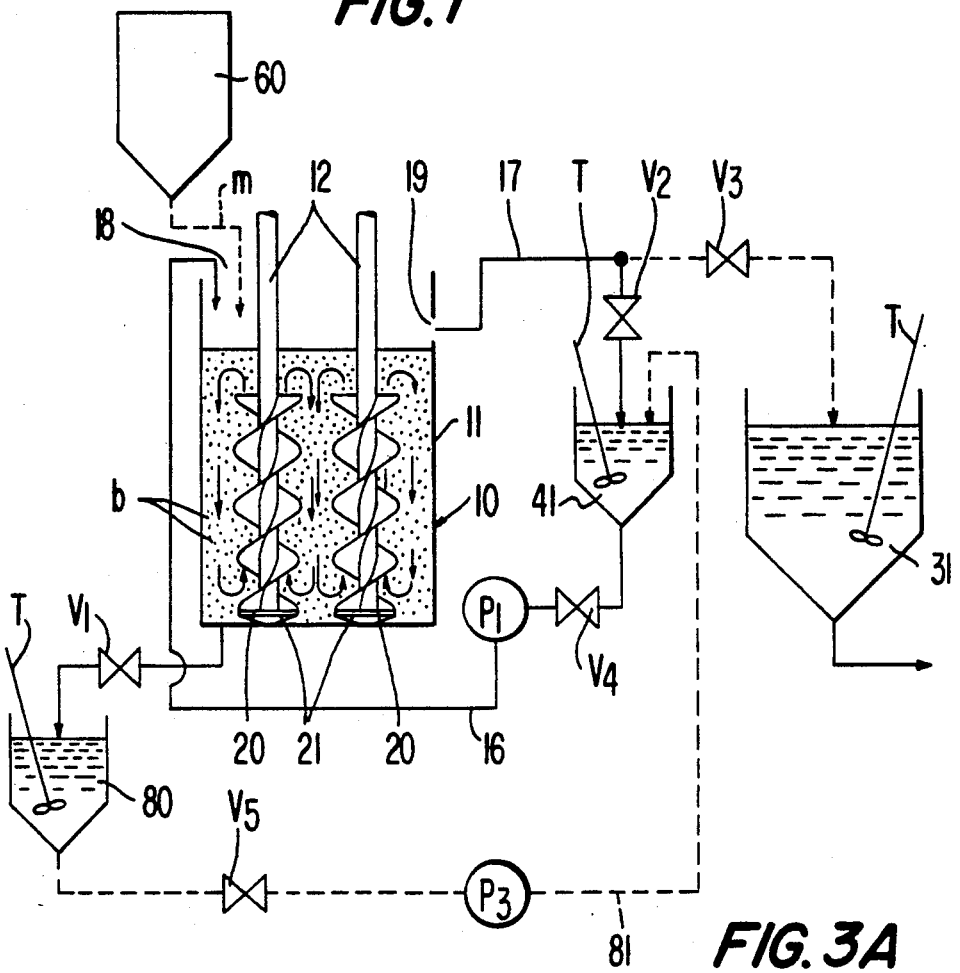
FIG. 1 is a schematic piping diagram of the first embodiment of the present invention.

FIG. 1 shows the first embodiment in which a pulverizer 10 includes a cylindrical shell 11 filled with a pulverizing medium b such as steel balls to a predetermined height and two screw shafts 12 rotatably mounted in the shell 11. With the screw shafts 12 rotating, a particulate material m to be pulverized is fed from a supply bin 60 into the shell 11. The material m will be mixed with the pulverizing medium b as shown by arrows in the drawing and pulverized by the friction between the particles themselves and with the medium b into a particulate product c. The screw shafts may be driven by two separate motors or may be coupled together by means of a gear or a belt to drive them with a single motor.

Each screw shaft 12 has its blade 26 tapered at its lower end portion so that its diameter will gradually decrease toward its bottom end and has a disk 20 secured to its bottom coaxially with its shaft 12. The disk 20 has a liner 21 molded of ceramic and bolted to its bottom so that its bottom surface will be in the shape of an inverted cone. The liner 21 serves to protect the disk 20 from wear.

According to the kind of the material to be pulverized and the process, the liner 21 may be made of a wear-resistant rubber or metal instead of ceramic. The disk 20 and the liner 21 may be made of a wear-resistant material such as cast iron containing a large amount of chromium and may be integral with each other. Also, the disk 20 may be made of ordinary cast iron or steel so that its bottom face will have an inverted conical shape and have the bottom face covered with a wear-resistant layer formed by the heat spraying of ceramic, a coating of ceramic powder or the fusing of a highly wear-resistant alloy thereon.

An auxiliary bin 80 is connected to the bottom of the shell 11 through an on-off valve V1. By opening the valve V1, the material m (or the particulate product c) will fall by gravity or be drawn forcibly by a pump into the auxiliary bin 80.

A conduit 17 connects an outlet 19 formed at the upper part of the shell 11 with an intermediate bin 41 through an on-off valve V2 and with a product collector bin 31 through an on-off valve V3. The slurry overflowing out of the outlet 19 (which contains the product c) will be fed into the intermediate bin 41 when the valve V2 is open and the valve V3 is closed and into the collector bin 31 when the valve V2 is closed and the valve V3 is open.

The intermediate bin 41 is connected with an inlet 18 of the shell 11 through a return pipe 16 provided with a pump P1 and an on-off valve V4. By opening the valve V4 and activating the pump P1, the slurry in the intermediate bin 41 containing the pulverized product c will flow back into the shell 11 through the pipe 16. Also, the intermediate bin 41 is connected with the auxiliary bin 80 through a feed pipe 81 provided with a pump P3 and an on-off valve V5. By opening the valve V5 and activating the pump P3, the slurry in the auxiliary bin 80 will be fed into the intermediate bin 41. Character T designates an agitator.

While the screw shafts 12 are rotating, a centripetal force will act on the disks 20 owing to the inverted conical shape of their bottom face, thus allowing the screw shafts to rotate without running out of true.

The blade 26 of each screw shaft 12 has a diameter at its lower portion which decreases gradually toward its bottom end. This will allow the blade to wear uniformly over the entire length. If its diameter is uniform from end to end, the blade 26 will wear more rapidly at its lower portion than at the upper part. This is because the lower portion of the blade 26 mainly serves to provide an initial movement of the medium.

Figure 4:
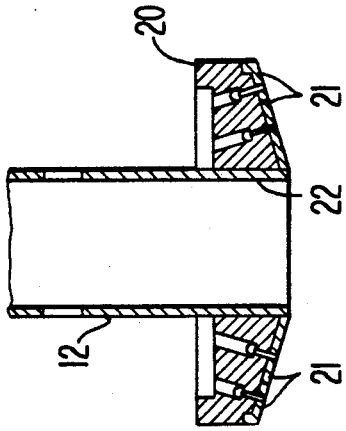
FIG. 4 is a sectional view of a portion of a modification of the first embodiment.
Figure 14:
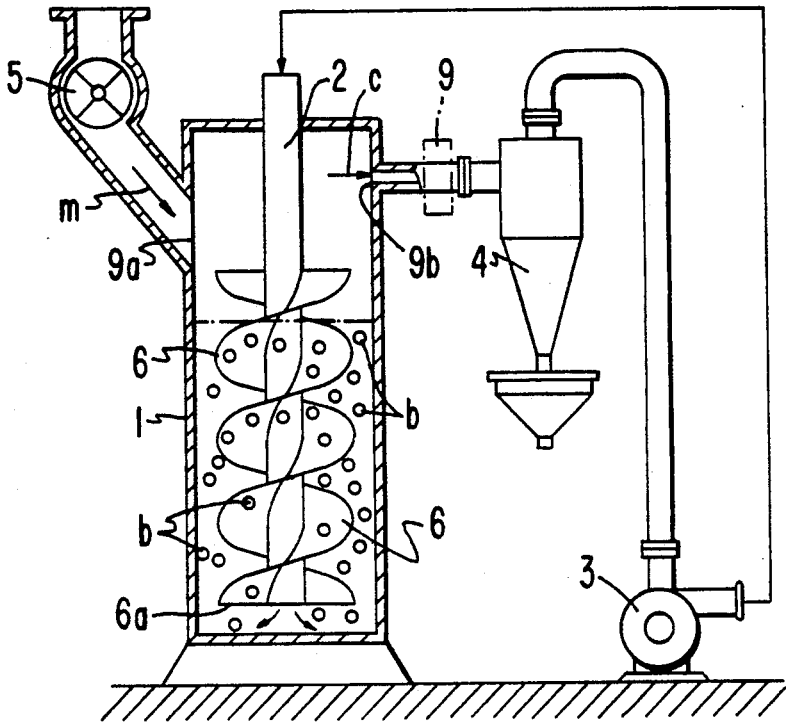
FIG. 14 PRIOR ART
FIG. 14 is a schematic view of a prior art apparatus.
Figure 15:
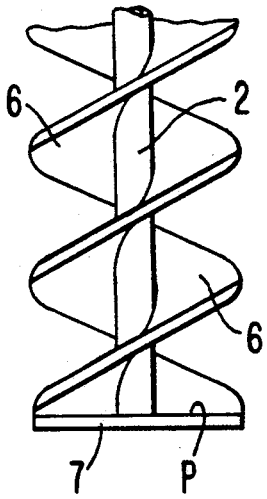
FIG. 15 PRIOR ART
FIGS. 15 and 16 are sectional views of a portion of prior art pulverizers.
Figure 16:
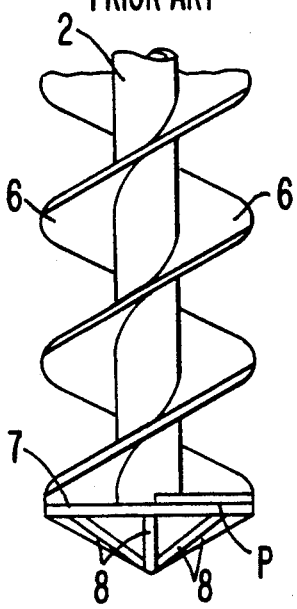
FIG. 16 PRIOR ART
Figure 17:
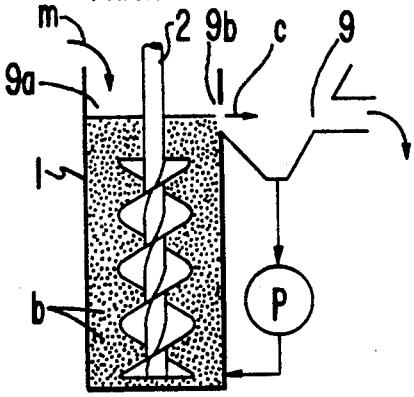
FIG. 17 PRIOR ART
FIG. 17 is a schematic piping diagram of a prior art apparatus.

FIG. 4 shows a modification of the first embodiment in which the screw shaft 12 is hollow and has its bottom end inserted into a hole 22 formed in a disk 20 so as to enable feed of fluid into the shell through the hollow screw shaft 12, as in the device of FIG. 14 which is a conventional apparatus. The disk 20 in this modification having its bottom face shaped in an inverted truncated cone will provide the same effects as with the disk in the first embodiment.

Figure 5:
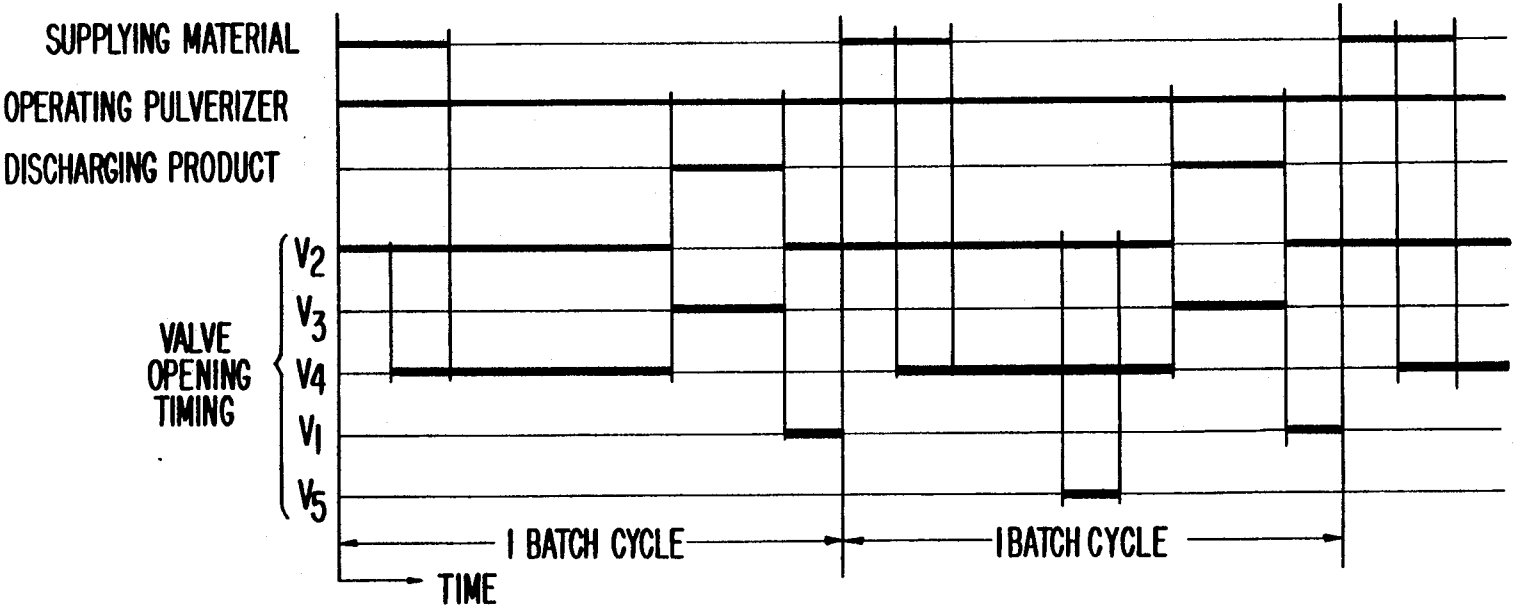
FIG. 5 is a timing chart showing the operating procedure for the first embodiment.

Now the operation of the first embodiment will be described with reference to the timing chart of FIG. 5 in which solid lines mean that the respective parts are in operation or opened.

In the first place, the valve V2 is opened, the pulverizer 10 is activated and the material m to be pulverized is fed into the shell 11 together with water. The material m will be pulverized and classified while flowing in up-and-down currents in the shell. The pulverized particulate product c will be classified and leave the shell 11 from the outlet 19 so as to flow through the conduit 17 into the intermediate bin 41.

The two screw shafts 12 will serve to form not simple but rather complicated currents in the shell. This will allow the pulverizing medium b to flow about in random directions, thereby pulverizing the material m more smoothly and more efficiently than with a single screw shaft.

The screw shafts 12 may be rotated in the same direction or in the opposite direction to each other. Also they may be rotated at the same speed or at different speeds from each other. The screw shafts may be arranged so that the direction of twist of their blades will be opposite to each other.

When the intermediate bin 41 becomes full, the supply of the material m is stopped and the on-off valve V4 is opened to feed the slurry in the intermediate bin 41 into the shell 11 by the pump P1. The slurry is thus circulated between the shell 11 and the intermediate bin 41 while being pulverized.

When the product c flowing out of the shell 11 is pulverized to a desired particle size, the valve V2 is closed while the valve V3 is opened to direct the slurry containing the pulverized product c into the collector bin 31. When all slurry in the intermediate bin 41 is pumped out, the pump P1 is stopped and the valve V4 is closed.

Then the valve V1 is opened to transfer the slurry in the shell 11 into the auxiliary bin 80. The slurry in the shell 11 may be drawn out by means of a pump so as to be fed into the collector bin 31. But the slurry in the shell 11 contains unpulverized coarse particles which are unacceptable as an end product, because part of the slurry is not circulated through the apparatus but remains settled in the shell 11 and the piping. Thus it is preferable to transfer the slurry in the shell to the auxiliary bin 80 so as to feed it back to the intermediate bin 41 during the next pulverizing cycle. The above-described operation can be repeated without stopping the pulverizer 10.

In the first embodiment, if the material in the shell 11 can be pulverized smoothly into a particulate product c having a desired particle size without the fear of coarse particles being fed into the collector bin 31, the intermediate bin 41 may be omitted. The need for it is especially small if the material is pulverized under low-density conditions.

Figure 6:
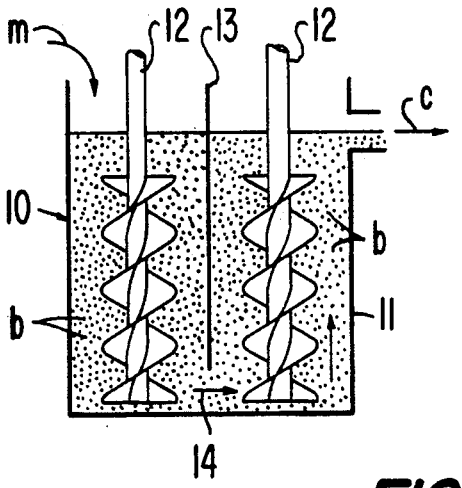
FIGS. 6 through 13 are schematic views of the other embodiments.

FIG. 6 shows the second embodiment in which a partitioning wall 13 is provided to separate the screw shafts 12 from each other and which is provided with a hole 14.

The material m to be pulverized is fed into the first or front stage (lefthand side of FIG. 6) in the shell 11 and pulverized firstly by the first screw shaft 12. The material in the first stage or chamber will flow little by little into the second or rear stage through the hole 14 and be further pulverized by the second screw shaft 12. This will allow all the material to be pulverized uniformly without the fear of the coarse material being fed without being fully pulverized.

Figure 7:
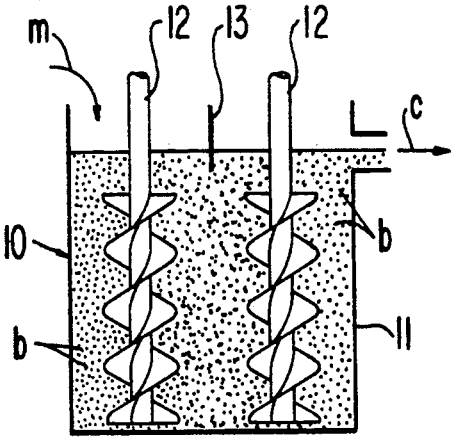
Figure 8:
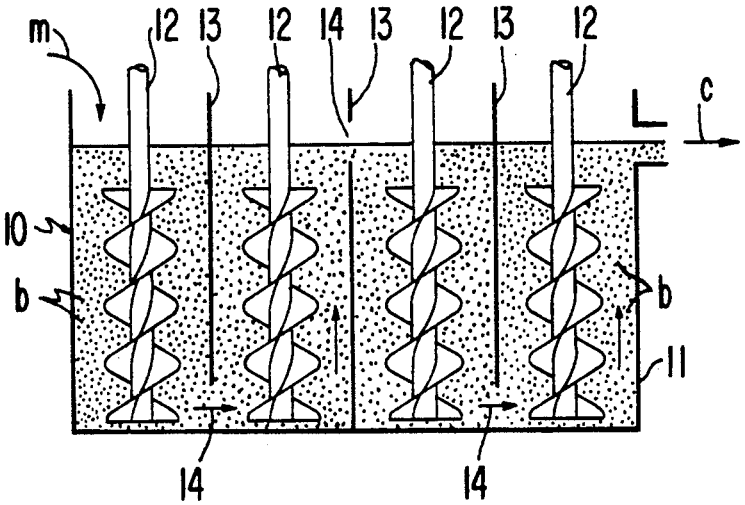

As shown in FIG. 7, the partitioning wall 13 may be provided only near the surface of the material in the shell. Also, as shown in FIG. 8, three or more screw shafts 12 may be provided in the shell with partitioning walls 13 arranged between the screw shafts 12. The holes 14 are formed alternately at the bottom and the top of the respective walls 13 so that the slurry will flow across the shell 11 in a zigzag manner as shown by arrows.

Figure 9:
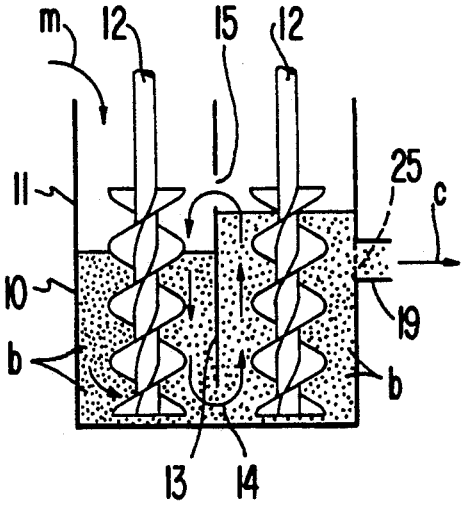

FIG. 9 shows the third embodiment in which the partitioning wall 13 is formed with a hole 15 in its upper part. The righthand screw shaft 12 is adapted to be rotated faster than the lefthand one.

Owing to the difference in the speed of revolution between the two screw shafts, the slurry level in the rear half portion will become higher than that in the front half portion. This will cause the slurry to circulate between the front and rear half portions through the holes 14 and 15 in the partitioning wall 13. This arrangement will be especially efficient in pulverizing a material having a poor flowability.

In this embodiment, the shell 11 is formed with an outlet 19 disposed below the hole 15. The outlet 19 is covered with a screen 25 to prevent the leakage of the pulverizing medium b. The screen 25 may be a porous plate or a bar screen.

A difference in the slurry level between the two chambers can be created by locating the rear screw shafts 12 nearer to the partitioning wall 13 than the front screw shaft 12. Means for moving the screw shafts 12 toward and away from the partitioning wall 13 may be provided to adjust the distance between the screw shaft 12 and the wall 13. It may be adjusted continuously during operation. Also, the screw shafts 12 may be provided with means for variably controlling their revolving speeds independently of each other.

Also, the front screw shaft may have its blade pitch smaller than that of the rear screw shaft to create the aforementioned difference in the slurry level.

Figure 10:
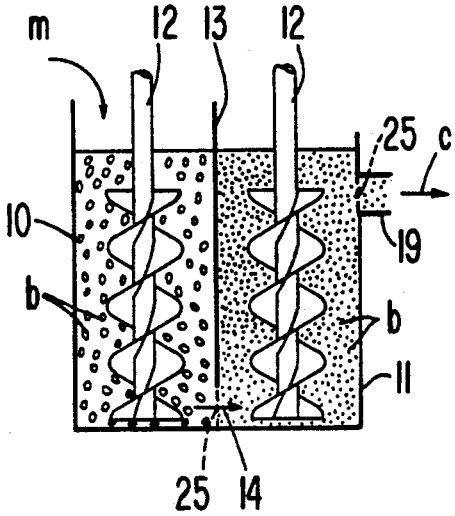

FIG. 10 shows the fourth embodiment in which the pulverizing medium b in the front chamber has a larger particle size than the one in the rear chamber and the hole 14 formed in the partitioning wall 13 is covered with a screen similar to the screen 25 used in the third embodiment to prevent the pulverizing media b from mixing with each other.

With this arrangement, a material having a larger particle size than with any prior art pulverizer can be pulverized reliably and smoothly. This is because the pulverizing step is divided into a plurality of stages.

Figure 11:
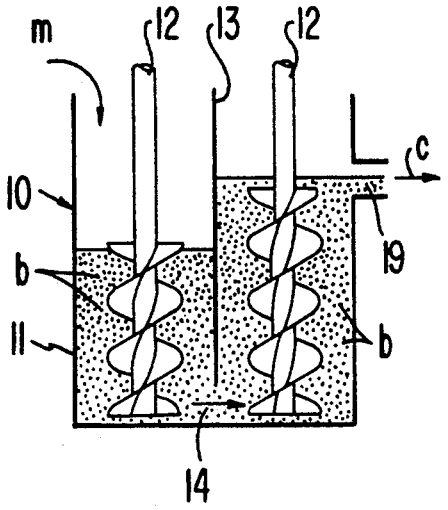

FIG. 11 shows the fifth embodiment in which the screw shafts 12 have the top end of their respective blades terminated at different levels. This arrangement will permit a smooth flow of the pulverizing medium b in the shell 11, thus improving the efficiency of pulverization.

In this embodiment, either one of the front and rear screw shafts may have its blade higher than the other. Also, the screw shafts 12 in the first embodiment may have one of their blades higher than the other, too.

Figure 12:
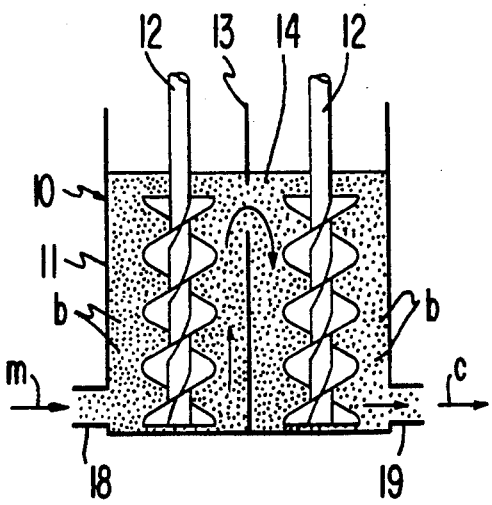

FIG. 12 shows the sixth embodiment in which the partitioning wall 13 is provided with a hole 14 only at its upper part. The material m in the front chamber will flow into the rear chamber through this hole 14.

Figure 13:
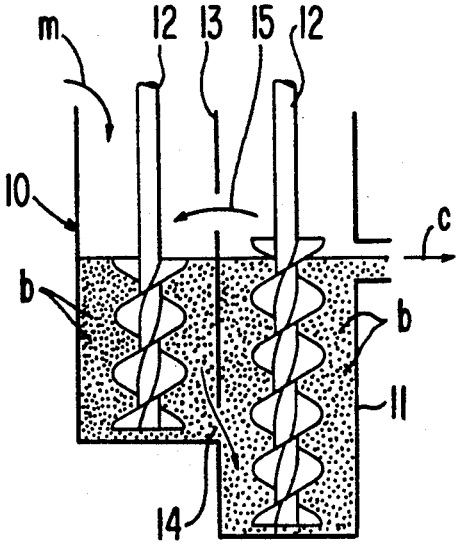

In the seventh embodiment shown in FIG. 13, the front screw shaft 12 has its bottom end terminated short of the bottom end of the rear screw shaft. The front half portion of the shell has its bottom correspondingly shallow. The partitioning wall 13 is provided at both its upper and lower parts with holes 15 and 14, respectively. Thus, the pulverizing medium b can be circulated smoothly between the front and rear half portions of the shell.

The shell 11 may have a stepped bottom as in this embodiment even in the embodiments in which the slurry is not adapted to be circulated between the front and rear half portions e.g. as with the pulverizer shown in FIG. 6.

All the above-mentioned embodiments are a wet type apparatus using water as a fluid, but any of the embodiments may be used for a dry type of pulverizer using air as a fluid. The screw shafts may have different pitches from each other or each screw shaft may even have different pitches at different portions thereof.

Figure 2:
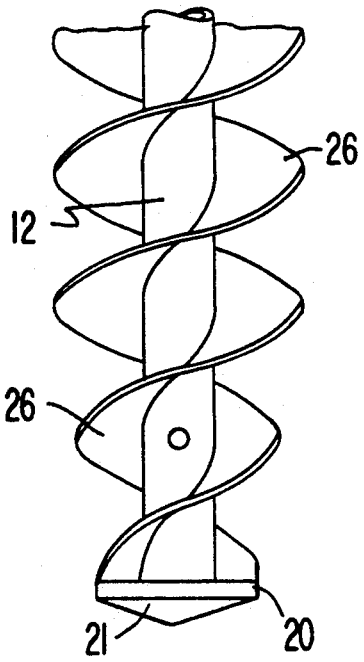
FIG. 2 is a perspective view of a portion of a screw shaft for the same.
Figure 3A:
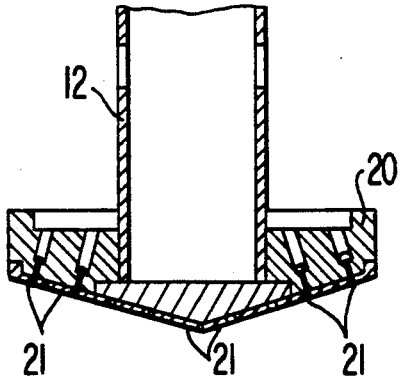
FIG. 3*a* is a sectional view of the bottom of the screw shaft.
Figure 3B:
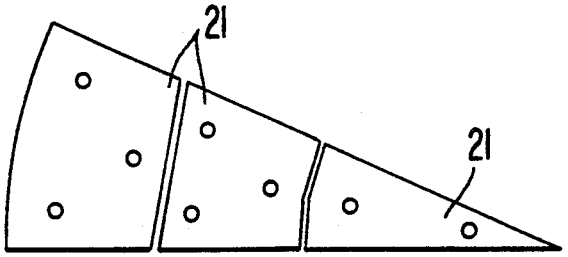
FIG. 3*b* is a bottom plan view of a segment of a protective liner for the same.

Although all the preferred embodiments have a plurality of screw shafts, the screw shaft shown in FIGS. 2 and 3 has the effect of avoiding runout if it is used single shaft, not in a plural shaft arrangement.

INDUSTRIAL APPLICATION

The pulverizing apparatus according to the present invention can be used for the production of a fine or granular material such as silica powder and other materials e.g. materials for a filler for sealing semiconductors, high-quality glass, lens, synthetic resin additives, artificial crystal, fiber, ceramics, agricultural chemicals, dentures and abrasives.

We claim:

1. An apparatus for pulverizing a material into a particulate product, comprising:

a shell having an inlet port and a discharge port;

a pulverizing medium filling said shell; and a vertical screw shaft having a screw blade thereon and rotatably mounted in said shell for agitating said pulverizing medium to pulverize the material fed into said shell through said inlet port into fine particles by friction between the particles thereof and with said pulverizing medium, said discharge port being positioned for removing the fine particles out of said shell; said screw shaft having a disk secured to the bottom of said screw shaft, said disk having a diameter substantially equal to the outside diameter of said blade of said screw shaft and a bottom surface in the shape of an inverted cone.

2. An apparatus for pulverizing a material into a particulate product, comprising:

a single shell having a single pulverizing medium accommodating space therein and having a material inlet port and a material discharge port opening into and out of an upper part of said space, respectively;

a pulverizing medium filling said space;

a plurality of vertical parallel screw shafts each having a screw blade thereon rotatably mounted in said shell and within said space in positions for agitating said pulverizing medium for causing said pulverizing medium to be agitated throughout said space to pulverize the material fed into said space through said inlet into fine particles by friction between the particles thereof and with said pulverizing medium, said discharge port being positioned for removing the fine particles out of said shell;

at least one partitioning plate provided between adjacent screw shafts to divide said space into a plurality of chambers and having an aperture at the bottom portion thereof within the pulverizing medium and having a further aperture at the upper portion thereof above the pulverizing medium; and means for driving said screw shafts in rotation.

3. An apparatus as claimed in any one of claim 2 wherein the respective shafts have screw blades with different widths.

4. An apparatus as claimed in any one of claim 2 wherein the respective shafts have screw blades with different pitches.

5. An apparatus as claimed in any one of claim 2 wherein said means for driving said screw shafts drives the respective shafts at different speeds of rotation.

6. An apparatus as claimed in any one of claim 2 wherein each said screw shaft has a disk secured to the bottom of said shaft and said disk has a diameter substantially equal to the outside diameter of the blade on said screw shaft and has a bottom surface in the shape of an inverted cone.

7. An apparatus for pulverizing a material into a particulate product, comprising:

a single shell having a single pulverizing medium accommodating space therein and having a material inlet port and a material discharge port opening into and out of an upper part of said space, respectively;

a pulverizing medium filling said space;

a plurality of vertical parallel screw shafts each having a screw blade thereon rotatably mounted in said shell and within said space in positions for agitating said pulverizing medium for causing said pulverizing medium to be agitated throughout said space to pulverize the material fed into said space through said inlet into fine particles by friction between the particles thereof and with said pulverizing medium, said discharge port being positioned for removing the fine particles out of said shell;

each said screw shaft having a disk secured to the bottom of said shaft and said disk having a diameter substantially equal to the outside diameter of the blade on said screw shaft and having a bottom surface in the shape of an inverted cone;

said inlet being in one chamber and said outlet being in an other chamber; and means for driving said screw shafts in rotation and driving said screw shaft in said other chamber at a speed of rotation greater than the speed of rotation of said screw shaft in said one chamber for causing said pulverizing medium to circulate from said one chamber to said other chamber through said aperture.

8. An apparatus for pulverizing a material into a particulate product, comprising:

a single shell having a single pulverizing medium accommodating space therein and having a material inlet port and a material discharge port opening into and out of an upper part of said space, respectively;

a pulverizing medium filling said space;

a plurality of vertical parallel screw shafts each having a screw blade thereon rotatably mounted in said shell and within said space in positions for agitating said pulverizing medium for causing said pulverizing medium to be agitated throughout said space to pulverize the material fed into said space through said inlet fine particles by friction between the particles thereof and with said pulverizing medium, said discharge port being positioned for removing the fine particles out of said shell;

each said screw shaft having a disk secured to the bottom of said shaft and said disk having a diameter substantially equal to the outside diameter of the blade on said screw shaft and having a bottom surface in the shape of an inverted cone; and means for driving said screw shaft in rotation;

said inlet being in one chamber and said outlet being in an other chamber, and said screw shaft in said one chamber having a screw blade with a smaller pitch than the screw blade on the screw shaft in said other chamber for causing said pulverizing medium from said one chamber to flow to said other chamber.

9. An apparatus for pulverizing a material into a particulate product, comprising:

a single shell having a single pulverizing medium accommodating space therein and having a material inlet port and a material discharge port opening into and out of an upper part of said space, respectively;

a pulverizing medium filling said space;

a plurality of vertical parallel screw shafts each having a screw blade thereon rotatably mounted in said shell and within said space in positions for agitating said pulverizing medium for causing said pulverizing medium to be agitated throughout said space to pulverize the material fed into said space through said inlet fine particles by friction between the particles thereof and with said pulverizing medium, said discharge port being positioned for removing the fine particles out of said shell;

each said screw shaft having a disk secured to the bottom of said shaft and said disk having a diameter substantially equal to the outside diameter of the blade on said screw shaft and having a bottom surface in the shape of an inverted cone; and means for driving said screw shaft in rotation;

said inlet being in one chamber and said outlet being in an other chamber, and a partitioning plate between said screw shafts dividing said space into said chambers, and said screw shafts in said other chamber being closer to said partitioning plate than the screw shaft in the one chamber for causing said pulverizing medium to circulate from said one chamber to the other chamber.

10. An apparatus for pulverizing a material into a particulate product, comprising:

a single shell having a single pulverizing medium accommodating space therein and having a material inlet port and a material discharge port opening into and out of an upper part of said space, respectively;

a pulverizing medium filling said space;

a plurality of vertical parallel screw shafts each having a screw blade thereon rotatably mounted in said shell and within said space in positions for agitating said pulverizing medium for causing said pulverizing medium to be agitated throughout said space to pulverize the material fed into said space through said inlet fine particles by friction between the particles thereof and with said pulverizing medium, said discharge port being positioned for removing the fine particles out of said shell;

each said screw shaft having a disk secured to the bottom of said shaft and said disk having a diameter substantially equal to the outside diameter of the blade on said screw shaft and having a bottom surface in the shape of an inverted cone; and means for driving said screw shaft in rotation;

said inlet being in one chamber and said outlet being in an other chamber, and said one chamber is shallower than said other chamber and having the bottom at a level higher than the bottom of said other chamber and the respective screw shafts in said chambers extend to the bottoms of said chambers.

* * * * *